United States Patent [19]

Dugge

[11] Patent Number: 5,063,858

[45] Date of Patent: Nov. 12, 1991

[54] COVERED HOPPER RAILWAY CAR WITH DROP BOTTOM DOORS AND SUBSTANTIALLY VERTICAL OUTLETS TO MAXIMIZE DISCHARGE AREA

[75] Inventor: Richard H. Dugge, Des Peres, Mo.

[73] Assignee: ACF Industries, Incorporated, Earth City, Mo.

[21] Appl. No.: 428,630

[22] Filed: Oct. 30, 1989

[51] Int. Cl.[5] ..... B61D 7/02; B61D 7/16

[52] U.S. Cl. ..... 105/253; 105/255; 105/280

[58] Field of Search ..... 105/247, 248, 253, 255, 105/254, 280

[56] References Cited

U.S. PATENT DOCUMENTS

| | | | |
|---|---|---|---|
| 678,104 | 6/1901 | Souder | 105/248 |
| 820,240 | 5/1906 | Mulock | 105/248 |
| 1,121,165 | 12/1914 | Christianson | 105/248 |
| 1,422,133 | 7/1922 | Robider | 105/247 |
| 2,046,040 | 6/1930 | Schellentrager | 105/254 |
| 3,169,491 | 2/1965 | Darlington et al. | 105/253 |
| 3,483,830 | 12/1969 | McGrath | 105/253 X |
| 3,838,649 | 10/1974 | Barnard | 105/253 X |
| 4,884,511 | 12/1989 | Hallam et al. | 105/247 |

OTHER PUBLICATIONS

"N and W Will Build 85-Ton Hopper Cars", *Railway Locomotives and Cars*, Apr. 1960, pp. 37–40.

"High Capacity Covered Hoppers", Railway Locomotives and Cars, Nov. 1965, pp. 27t.

*Primary Examiner*—Robert J. Oberleitner

*Assistant Examiner*—S. Joseph Morano

*Attorney, Agent, or Firm*—Polster, Polster and Lucchesi

[57] ABSTRACT

A covered hopper railway car (10) for transporting difficult-to-unload ladings includes a pair of parallel, spaced apart side walls (12*a*, 12*b*) and opposed end walls (14*a*, 14*b*). A roof (16) covers the car and has an opening (18) therein for loading lading into the car. The bottom has outlets (24*a*–24*g*) attached thereto for discharging lading from the car. Each outlet comprises a drop-bottom outlet whose length and width are sufficient so as to substantially prevent lading from bridging over the outlet thereby facilitating discharge of the lading.

16 Claims, 5 Drawing Sheets

COVERED HOPPER RAILWAY CAR WITH DROP BOTTOM DOORS AND SUBSTANTIALLY VERTICAL OUTLETS TO MAXIMIZE DISCHARGE AREA

BACKGROUND OF THE INVENTION

This invention relates to covered hopper railway cars, and, more particularly, to such a car having an outlet facilitating discharge of certain type ladings which are particularly difficult to unload.

Covered hopper railway cars are used to transport numerous types of ladings. For economical use of such cars, it is advantageous if the lading, when it reaches its destination, can be quickly and efficiently discharged from the car. While this occurs with most ladings, in some instances, the lading is of a type where off-loading the commodity is an arduous, time consuming and hence expensive task. One example of such a commodity is corn gluten. This corn by-product is a fibrous material shipped in pelletized form.

A problem arises when corn gluten, which contains sugar, is shipped in covered hopper cars, especially in hot weather. During transport, the pellets, which are sticky from the sugar, compact as a result of their combined weight and vibration of the car as it moves over the tracks. A typical hopper car in which the gluten is shipped has four (4) bottom discharge outlets each of which are 24" long and 48" wide. As the gluten compacts, it bridges across these outlets. At its destination, it is not unusual for only a few pellets of the corn gluten to discharge from the cutlets when they are opened. Thus, even though the car has thirty-two (32) square feet of open discharge area, it may take up to three days to off-load the rest of the gluten. The off-loading operation not only requires men with pile drivers standing on top the car and pounding down on the lading to force it through the outlets in the car bottom; but also, attaching vibrators to the sides of the car in an attempt to shake the pellets loose.

If workers are not careful, they can punch holes through the bottom of the car with their pile drivers necessitating a repair. Thus, the expenses involved in off-loading this type lading includes not only extensive labor costs, but also the time the car is out of revenue service, and perhaps even repair costs. A car being out of revenue service is especially important where, as is often the case, the cars involved are leased and the lessee depends upon his lease revenue to defray the costs of the lease.

It is known to use wide mouthed outlets in particular types of open-top hopper cars. Such outlets are used, for example, in coal carrying hopper cars. A car with this type outlet is disclosed in U.S. Pat. No. 4,829,908 to Hallam. However, the ladings carried in such cars are substantially different from the types of lading carried in covered hopper railway cars.

SUMMARY OF THE INVENTION

Among the several objects and features of the present invention is the provision of a covered hopper railway car for carrying ladings, such as corn gluten, which are particularly difficult to unload because they tend to bridge across the car's outlets;

The provision of such a car which is essentially bottomless whereby no amount of bridging will keep lading from collapsing through the bottom of the car; the provision of such a car having outlets whose length and width are such as not to be readily bridged by lading carried in the car; the provision of such a car having outlets permitting quicker and more economical unloading;

The provision of such a car having a plurality of drop-bottom outlets for discharging the lading;

The provision of such a car having outlets whose combined discharge area is several times that of conventional hopper cars;

The provision of such a car whose outlets are readily opened, and when opened, do not impede discharge of lading;

The provision of such a car whose slope sheets have a negative slope to prevent bridging of lading and to facilitate lading discharge;

The provision of such a car to be either a center-sill or a side-sill car; and,

The provision of such a car having an increased load carrying capacity.

Briefly stated, a covered hopper railway car of the present invention is disclosed for transporting ladings which are generally difficult to unload. The car includes a pair of parallel, spaced apart side walls, and opposed end walls. A roof covering the car has an opening therein for loading lading into the car. The car also has a bottom with means therein for discharging the lading from the car. The discharge means comprises at least one drop-bottom outlet whose length and width are sufficient to prevent the lading within the car generally above the outlet from bridging over the outlet thereby to facilitate discharge of lading. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 12:
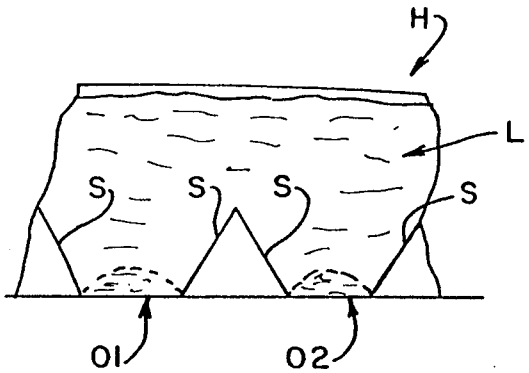
FIG. 12. PRIOR ART

Referring to the drawings, a covered hopper railway car of the present invention is indicated generally 10. Car 10 is used for transporting ladings of various types; but, in particular, ladings such as corn gluten which are known to be particularly difficult to unload. These ladings may have the characteristic of compacting during transport to their destination, and when delivered in conventional covered hopper railway cars, require of labor and time to unload. This is because the compacted lading bridges across the standard gravity outlets with which conventional covered hopper cars are equipped and thus Does not readily fall out the bottom of the car through the outlets. Referring to FIG. 12, a prior art covered hopper railway car H has outlets indicated 01 and 02. The car is filled with a lading L such as corn gluten. When the car arrives at its destination, and the unloading process begins, only a small amount of the lading will discharge (the amount represented by the dashed lines). The lading adjacent the outlet tends to bridge across the outlets and form a wedge of material which will not flow through the outlets of its own accord. Consequently, it often requires a number of worker days to unload a car, and the car is subject to damage during this process. As a result, the transportation costs for these types of lading can be substantially higher than those for more standard ladings.

Car 10 includes a pair of parallel, spaced apart side walls 12*a*, 12*b* and opposed end walls, 14*a*, 14*b*. The size and shape of the side walls and end walls are similar to those of conventional covered hopper railway cars and will not be described in detail. A roof 16 covers the car and is of a curved construction, sloping downward from the centerline or longitudinal axis of the car toward each sidewall. The roof has one or more openings 18 therein for truck lading into the car. Appropriate truck assemblies 20, 22 are mounted beneath respective ends of the car for its movement over railroad tracks.

Figure 8A:
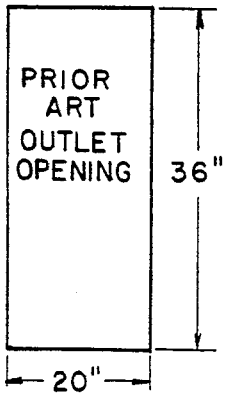
FIGS. 8*a*, 8*b*, and 8*c*, respectively, represent the discharge area of a standard prior art hopper car 20"×36" outlet, a prior art 24"×48" outlet, and the discharge area of one version of a drop bottom outlet of the present invention.
Figure 8B:
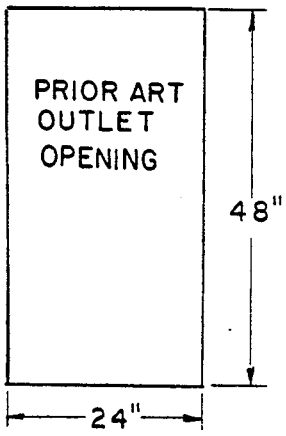

To discharge lading from the car, it is provided with at least one and preferably a plurality of drop-bottom outlets 24 which are capable of gravity discharging difficult to unload ladings substantially without bridging. Seven such outlets are shown in car 10, these being designated 24*a*–24*g*. The design and operation of each outlet is the same. The advantage of drop-bottom outlets in car 10 is the larger discharge area (see FIG. 8*c*) it provides compared with standard or conventional outlets (see FIG. 8*a*). For example, a standard covered hopper railway car is typically provided with four outlets each of which measures less than 20"×36" as shown in FIG. 8*a*. The total discharge area provided by such outlets is less than 20 square feet as represented in FIG. 8*a*. The outlets are equidistantly spaced along the length of the car between the truck assemblies 20 so there is an appreciable distance between adjacent outlets. This configuration of prior art cars enhances the chances for lading, such as corn gluten, to bridge across the outlets since the outlet is narrow and there is substantial bottom structure of the car between the outlets to support the compacted lading. Certain other prior art covered hopper railway cars are equipped with outlets measuring 24"×48" as represented in FIG. 8*b*; however, only four of these outlets are mounted on the car and the added discharge area provided by them is insufficient to alleviate the problem.

Figure 8C:
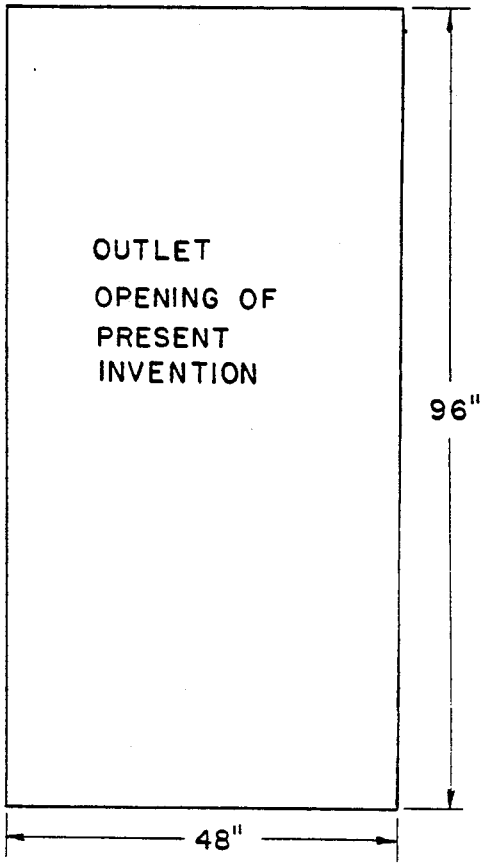

Referring to FIG. 8*c*, one version of the drop-bottom outlets of the type used in the present invention measure 48"×96". Each outlet preferably has more than about six (6) times the discharge area of the outlets shown in FIG. 8*a*; and at least four (4) times the discharge area of the outlets shown in FIG. 8*b*. Car 10 of the present utilizes seven drop-bottom outlets 24*a* —24*g* having a combined discharge area is 224 sq. ft. This is about six (6) times the discharge area of the outlets represented in FIG. 8*b*, and even more with respect to the outlets represented in FIG. 8*a*.

Figure 1:
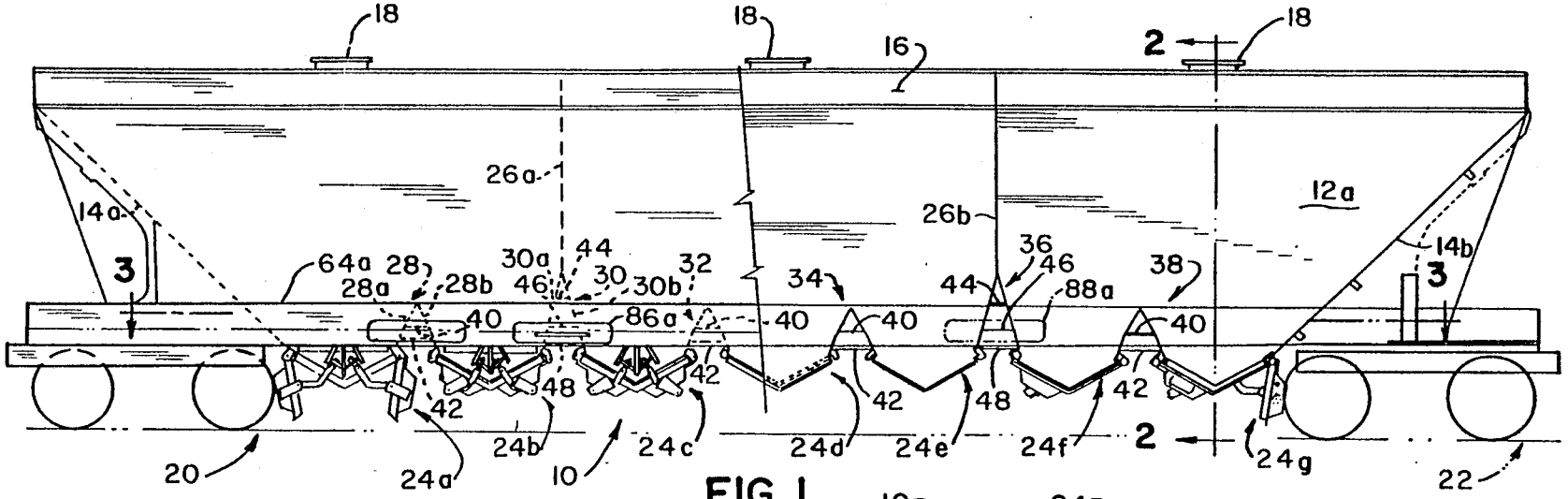
FIG. 1 is a side elevational view of a covered hopper railway car of the present invention having a plurality of drop bottom outlets with the leftmost outlet illustrated in its open position and with the other outlets closed.
Figure 3:
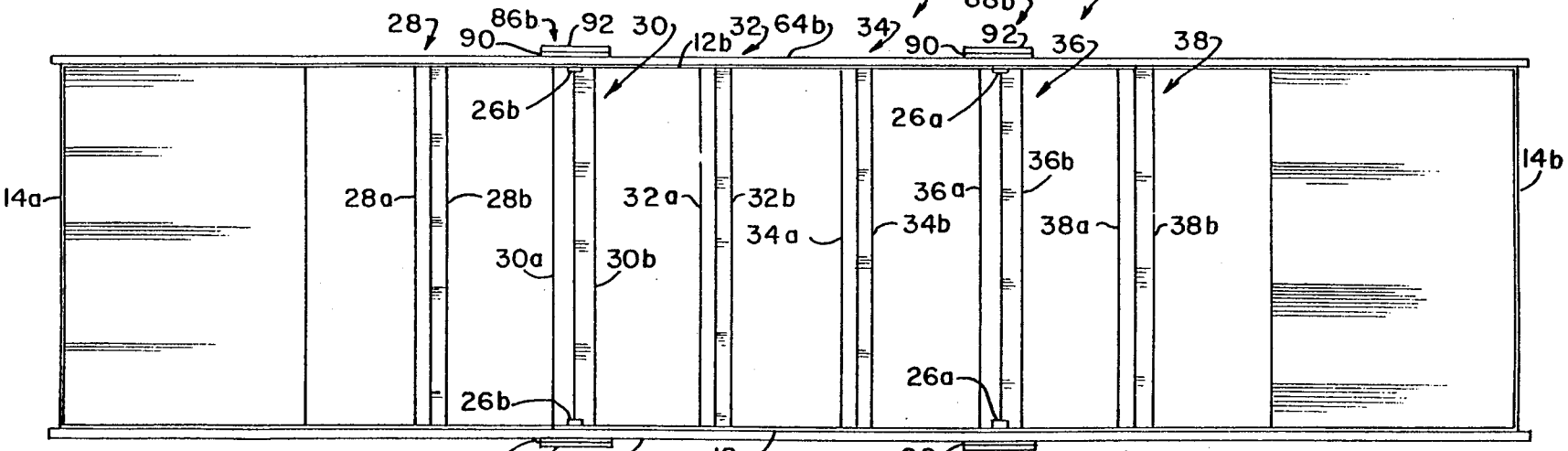
FIG. 3 is a horizontal cross sectional view of the car taken along line 3—3 in FIG. 1.
Figure 2:
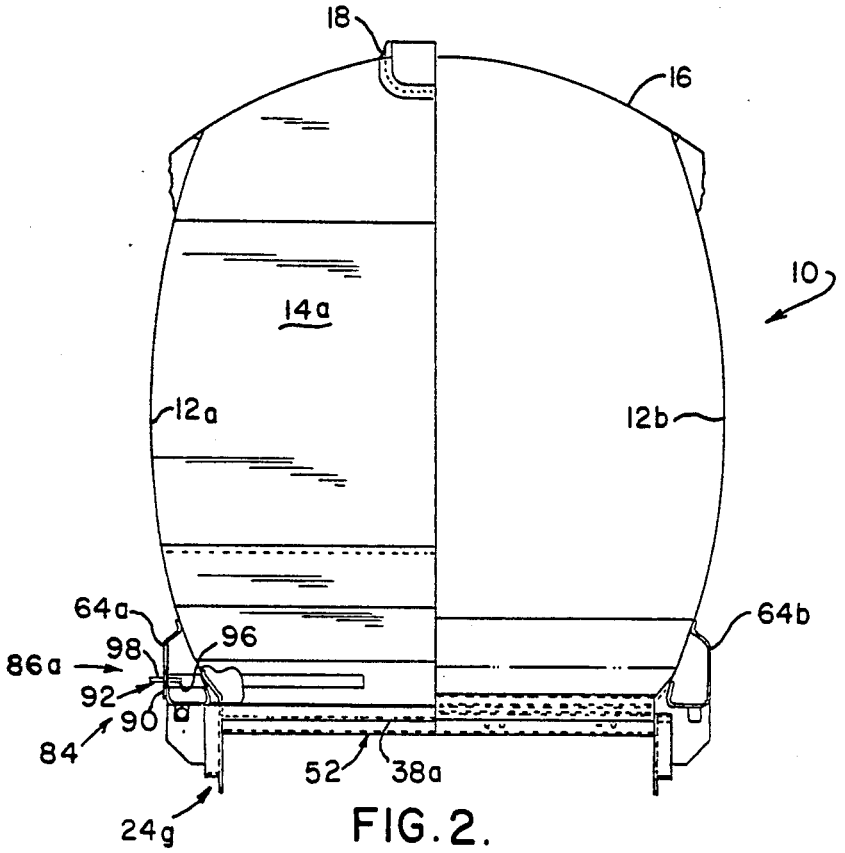
FIG. 2 is a vertical cross sectional view of the car taken along line 2—2 of FIG. 1.
Figure 4:
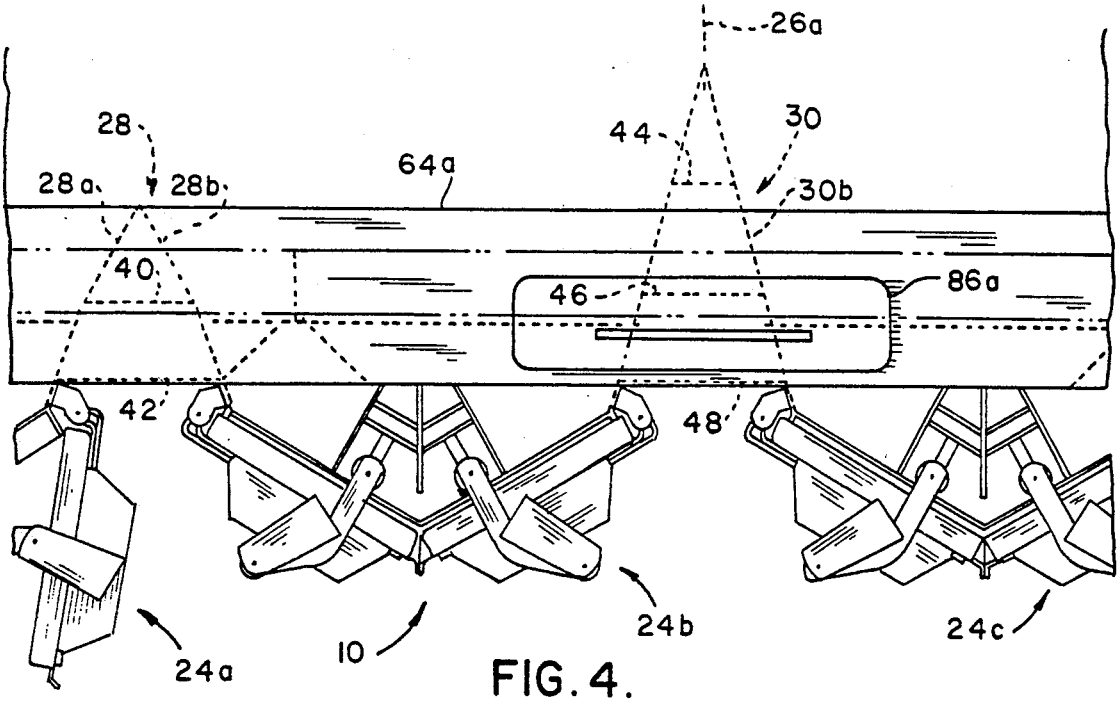
FIG. 4 is a partial side elevational view of the car on an enlarged scale, partly in section, illustrating in dotted lines the slope sheet arrangement of the car and illustrating a bottom drop door of the present invention.

As shown in FIGS. 1 and 3, the end walls of car 10 slope downwardly and inwardly. In addition, the car has inner, vertical partition sheets 26*a*, 26*b* spaced approximately one-third the length of the car from each end thereof. The outlets 24 are mounted on the bottom of the car using sets of slope sheets, as indicated at 28–38, which extend transverse to the longitudinal axis of the car. Each set of sheets includes a pair of sheets whose ends are attached, by welding, to the inner surface of sidewalls 12*a*, 12*b* at the base of the respective sidewalls. Starting at the left end of the car (as viewed in FIGS. 1, and 4), sheet set 28 includes a sheet 28*a* and a sheet 28*b*. These are connected at their respective upper ends and slope outwardly and downwardly toward the bottom of the car. At the upper end of the set, the angle between the sheets is approximately 30 degrees. A horizontal stiffening member 40 extends between the inner faces of the sheets at a point approximately midway their height. From there to the bottom of the sheets, their slope increases so the angle between the sheets is approximately 20 degrees. A second stiffening member 42 extends between the inner faces of the sheets at their base. Outlet 24*a* is secured to the bottom of car 10 by attaching one side of the outlet to the lower margin of end sheet 14*a*, and the other side of the outlet to the lower margin of sheet 28*a*.

Slope sheet set 30 comprises a pair of slope sheets 30*a*, 30*b*. These are joined at their upper ends to partition 26*a*. It will be noted that the height of these sheets is greater than those of set 28. Sheets 30*a*, 30*b* slope downwardly and outwardly from partition 26*a* with the angle formed between the sheets being approximately 15 degrees. Stiffening members 44, 46 respectively extend between the inner faces of these sheets at points approximately one-third and two-thirds their height, and a third stiffening member 48 extends between the inner faces of the sheets at the base of the sheets. Outlet 24*b* is secured to the bottom of car 10 by attaching one side of the outlet to the lower margin of sheet 28*b* and the other side of the outlet to the lower margin of sheet 30*a*.

Attachment of outlets 24*c*–24*f* is similar to that described above. Sheet sets 32, 34, and 36, and their respective sheets 32*a*, 32*b*, 34*a*, 34*b*, and 36*a*, and 36*b* which comprise them, are similar in construction to set 30; while sheet set 38, with its respective sheets 38*a*, 38*b*, is similar in construction to set 28. In each instance, the respective outlets are attached to the bottom of car 10 by attaching one side of the outlet to one sheet of one of the sets and the other side of the outlet to the adjacent sheet of the adjoining set of sheets. Outlet 24g has one side attached to the bottom margin of sheet 38b and the other side of the outlet is attached to the bottom margin of end sheet 14b.

Figure 5:
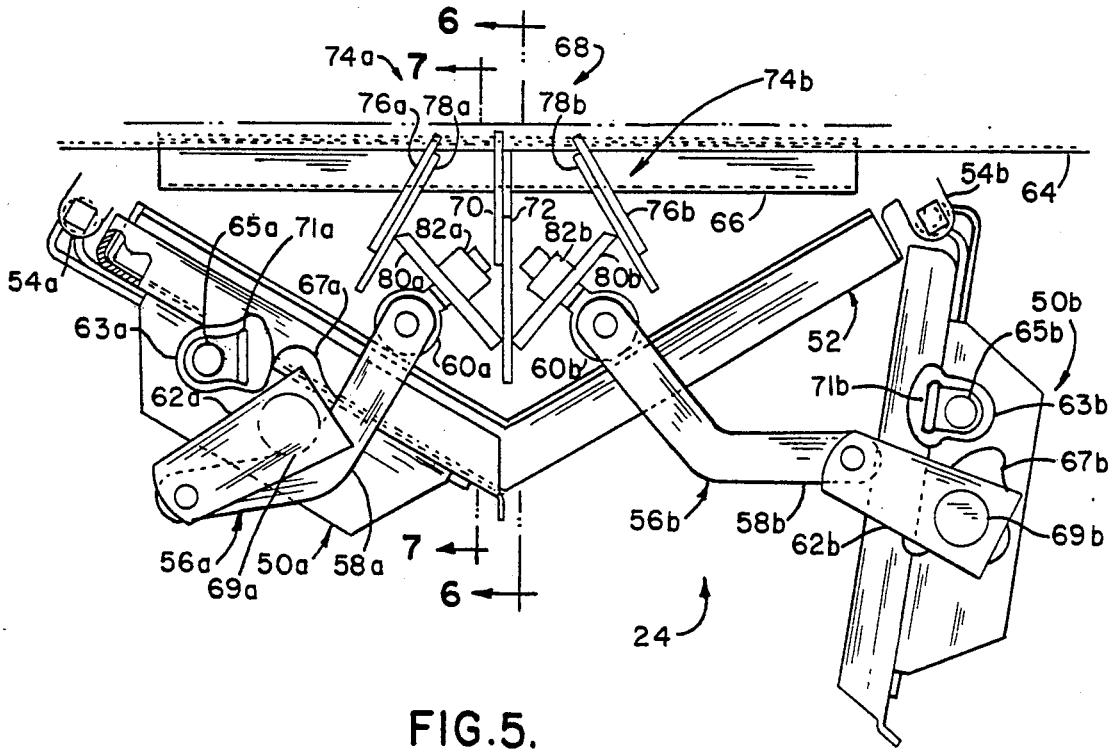
FIG. 5 is a side elevational view of a pair of bottom drop doors forming one of the drop bottom outlets of the present invention, one of which doors is closed (as shown on the left) and the other of which doors is open.
Figure 6:
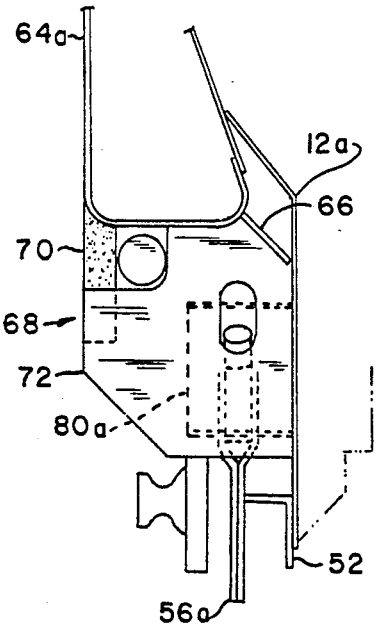
FIG. 6 is a vertical cross sectional view of one side of the outlet taken along line 6—6 of FIG. 5.
Figure 7:
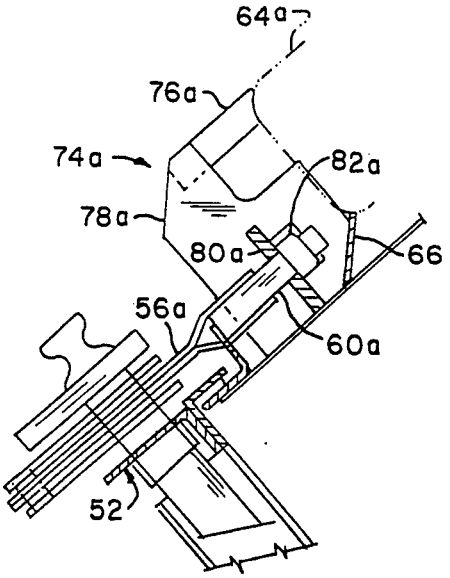
FIG. 7 is a vertical cross sectional view taken along line 7-7 of FIG. 5.

Referring to FIGS. 5–7, an outlet 24 is shown. Each outlet 24 includes a pair of doors 50a, 50b which are selectively and independently openable. The doors are hingedly mounted to a frame assembly 52 which is secured to the transversely extending sheets, as previously described. Side walls 12a, 12b are made to conform to the sloping side portions of the frame. The doors, which open in opposite directions to each other, have respective hinge mechanisms 54a, 54b. Each door has a separate mechanism 56a, 56b, respectively, for opening and closing it. The mechanisms include a lever arm 58a, 58b ; pivotally mounted at one end to an eyebolt 60a, 60b, respectively. The other end of the lever hingedly attaches to a socket 62a, 62b which, in turn, is rotatably attached to the respective doors. During unloading, a tool (not shown) is inserted into the socket to rotate it and open its associated door. For example, the socket 62a is rotated clockwise as shown in FIG. 5 to open door 50a. A locking lug 63a, 63b is mounted on a respective shaft 65a, 65b. Each lug has a cam surface which bears against a locking cam 67a, 67b, respectively. The locking cams are mounted on respective shafts 69a, 69b to the ends of which the respective sockets are also connected. The cam surfaces of lugs 63a, 63b bear against the locking cams 67a, 67bwhen doors 50a, 50bare closed to lock the doors in their closed position. To open a door, the locking lug is first rotated away from its associated locking cam. This can be done using the same tool which fits in the sockets 62a, 62b because the lugs each have a pocket 71a, 71b respectively, formed on its outer face in which the tool fits to rotate the lug away from the locking cam. The socket is then rotated and the door opened. The respective shafts 65a, 65b, 69a, and 69b extend across the car for correcsponding locking arrangements to be mounted on the other side of the car. The procedure is reversed to close the door. Each outlet has a similar mechanism on the other side of the car so the doors can be selectively opened from either side.

Car 10 has a side sill 64a, 64b, constructed along the base of the respective side walls. The door opening mechanisms 56a, 56b are suspended from the underside of the side sills. A gusset 66 extends lengthwise of frame assembly 52 and extends between thee underside of the side sill and the side wall of the car. A gusset assembly 68 is attached to the side sill at a point midway the length of the outlet. The assembly comprises a first vertical installed plate 70 and a second and longer vertical plate 72. The plates are mounted back-to-back. The upper end of plate 72 depends from the underside of the side sills. A and the inner face of the plate is attached to the side wall of car 10. Plate 70, which is narrower than plate 72, is attached to the outer margin of plate 72 and has a contoured upper face so to extend around the bottom of the side sill and up its side. The upper end of the plate is attached to the side sill for example, by welding.

Additionally, respective gusset assemblies 74a, 74b are attached to the side sill and side wall of the car. These are similar to assembly 68 in that each comprises a pair of back-to-back mounted plates 76a, 78a, and 78b respectively. Plates 78a, 78b attach to the side wall and underside of the side sill; while plates 76a, 76b are narrower plates which are attached to the outer margin of respective plates 78a, 78b and have contoured upper faces so to extend around the bottom of the side sill and up its side. The plates are attached to the side wall and side sill at an angle so the respective gusset assemblies are orthogonal to the sloping sides of frame assembly 52. An eybolt retainer plate 80a, 80b extends outwardly, at an angle, from the side wall of car 10 between the respective center and side gusset assemblies. Plate 80a extends between and is attached to one side of plate 72 and plate 78a, and plate 80b extends between and is attached to the other side of plate 72 and plate 80b. Each plate has an opening for the threaded shank of the respective eyebolts 60a, 60b. Nuts 82a, 82b secure the eyebolts to the respective plates.

Figure 9:
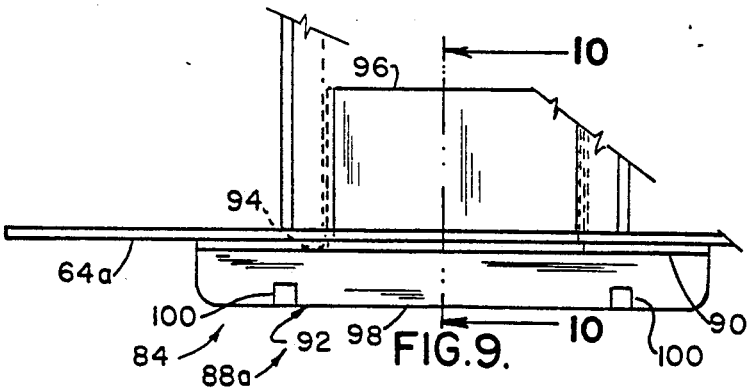
FIG. 9 is a partial top plan view of a vibration pad used on the car of the present invention.
Figure 10:
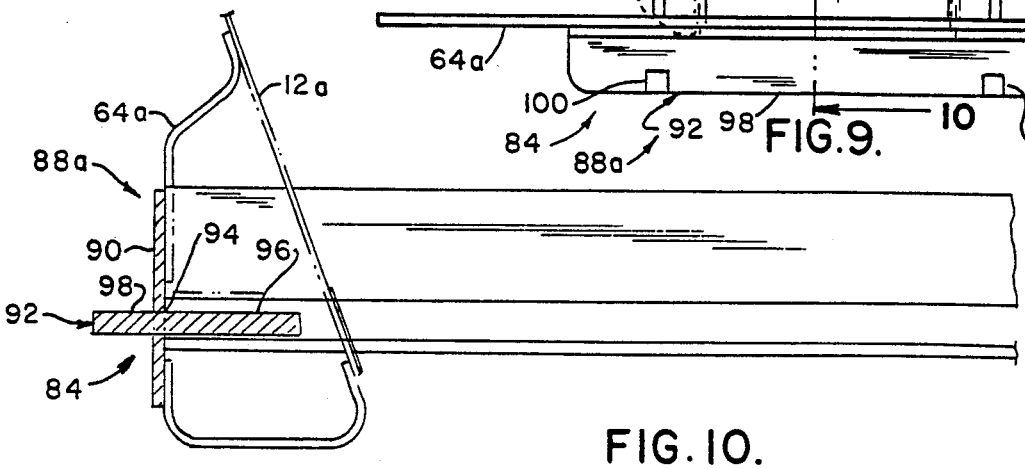
FIG. 10 is a vertical cross sectional view taken along line 10—10 of FIG. 9.

Car 10 further includes means 84 for vibrating the car. Vibration helps break loose compacted material and speeds unloading of the car. Means 84 includes a pair of vibrator pad units 86a, 86b and 88a, 88b attached to the respective sides sills of car 10. The two units on each side of the car are located between outlets 24b, 24c and outlets 24e, 24f. Each unit comprises a face plate 90 which is secured to outer side wall of the side sill and a plate 92 to which a vibration unit (not shown) attaches. Each plate 92 is horizontally mounted and extends through an opening 94 in plate 90 and the outer face of the side sill. As seen in FIG. 9, plate 92 is T-shaped having a tongue 96 inserted through opening 94. The outer portion 98 of the plate has a pair of guides 100, one at each end of the plate, for the vibrating equipment. When vibration units are attached to plates 92, the vibratory motion produced is transmitted through the side sills and side walls of the car to loosen the lading material.

In addition to the advantages of the present invention in providing a covered hopper railway car 10 which is faster to unload and which works particularly well with difficult ladings such as corn gluten, the present invention also provides a railway car having an increased lading capacity. Whereas a standard covered hopper car has a carrying capacity of, for example, 5,250 cubic feet, car 10 has a carrying capacity of 5,340 cubic feet. This is a 90 cubic foot or 1.7% volumetric increase. The increase is due to the added number of outlets used in car 10 and the consequent narrowness in spacing between the outlets. In addition, the steepness or near verticality of the sheets comprising the previously described sets of sheets serves to reduce the space which otherwise would be floor space of the car.

Figure 11:
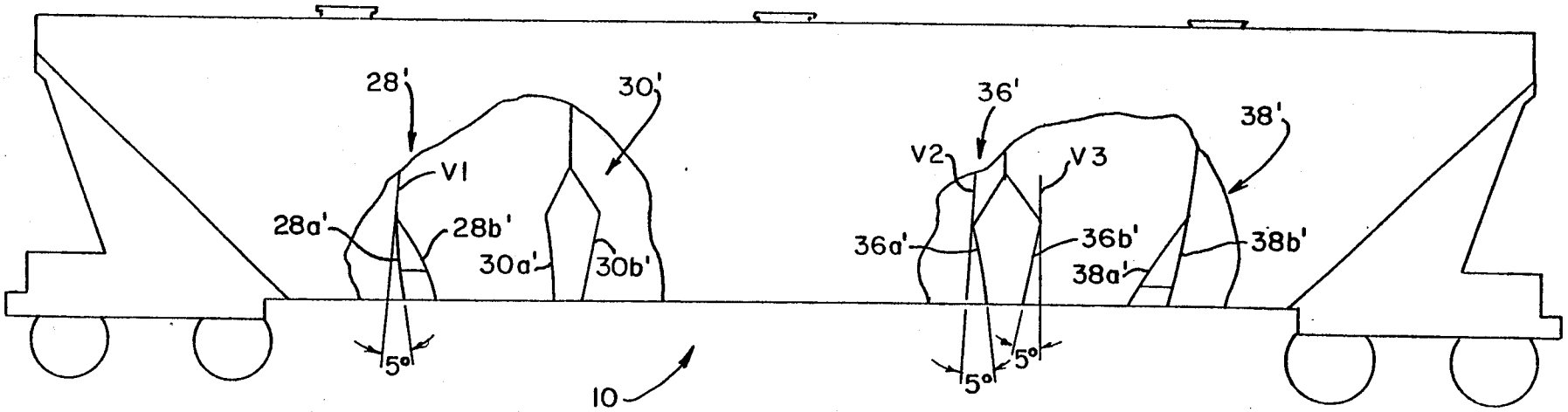
FIG. 11 is a partial sectional view of the car of FIG. 1 illustrating a slope sheet arrangement in which the slope sheets have a negative slope; and, FIG. 12 is a partial sectional view of a prior art covered hopper car illustrating how lading can bridge across the outlets in the bottom of the car.

Referring to FIG. 11, an alternate slope sheet structure of the present invention is shown. Four sets of slope sheets 28', 30', 36', and 38' are shown in FIG. 11, it being understood that the other sets of slope sheets are similarly constructed to those shown. In set 28' of slope sheets, slope sheet 28a, is configured so to have a reverse slope or negative angle with respect to a vertical reference line V1. This negative angle is, for example, five degrees (5°). The resultant reverse slope creates a surface to which material cannot cling since the angle of the sheet is in a direction for material to fall away from the surface rather than to cling to it. Moreover, the negative angle is so shallow that it does not impede subsequent discharge of the lading. Slope sheet 28b[1] is constructed the same as slope sheet 28b in that it has the same angular configuration as that slope sheet Sheet 28b[1] is longer than sheet 28b, however, because sheet 28a' is set at a different angle than sheet 28a. The set 38' of slope sheets is similarly configured to set 28' with sheet 38b' having the reverse slope.

In set 36' of slope sheets, both sheets 36a' and 36b' have reverse slopes or negative angles with respect to a vertical reference line V2 and V3, respectively. Again, the negative angle is about five degrees (5°). The upper portion of the slope sheets have the same angulation as the upper portion of the slope sheets 36a, 36b; but, again, these portions are longer than their counterparts because the negative angle of the lower portion of the sheets. Set 30' of slop sheets is constructed the same as set 36'.

It has been found that in prior art railcars having "positive" slope slope sheets (i.e., slop sheets which converge toward the bottom outlet), the downward, force of the lading on the "positive" slope slope sheets imparts a compression or compaction force on the lading which leads to bridging of the lading, as illustrated in FIG. 12. However, in accordance with one aspect of this invention, the provision of "negative slope" slope sheet (i.e., slope sheets which diverge in downward direction) prevent the slope sheets applying a compaction force to the lading thereby effectively preventing bridging, or at least lessening the tendency of the lading to bridge over the outlet.

It has also been found that for each outlet, only one of the two slope sheets associated with the outlet need have a reverse slope to facilitate discharge of lading through the outlet. It will be understood, however, that both slope sheets could have reverse slope.

It will be understood that while the car 10 described above is a side sill car, the car could also be a center sill car with the same advantageous results being obtained.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

I claim:

1. A covered hopper railway car for transporting ladings including a pair of parallel, spaced apart side walls;

opposed end walls;

a roof covering the car and having at least one opening therein for loading lading into the car;

a plurality of drop-bottom outlets for discharging lading from the car, each outlet having a pair of doors which are selectable openable, the length and width of each outlet being sufficient to substantially prevent lading from bridging over the outlet thereby facilitating discharge of lading;

means for attaching the outlets to the side walls of the car and including a pair of spaced apart sheets extending transverse to the longitudinal axis of the car and attached to the inner surface of the respective side walls of the car at the base thereof for attaching the outlets to the bottom of the car, the spacing between the sheets, at the bottom edge thereof being equal to the width of the outlet, the sheets for the respective adjacent ends of adjacent outlet being connected at their respective upper ends with the sheets being substantially vertical when attached to the side walls of the car thereby to maximize the discharge are provided by the outlets; and, vibrating means including a pair of vibrator pads attached each side of the car for connecting a vibrator to the pad to shake the car and loosen the lading therein.

2. The car of claim 1 including at least seven of said drop-bottom outlets mounted on the bottom of the car, the vibrating pads being attached to each side of the car between the second and third outlets from each respective end of the car.

3. The car of claim 2 wherein each drop-bottom outlet has a discharge area for lading of at least thirty-two square feet.

4. A covered hopper railway car for transporting a lading, including a pair of parallel, spaced apart side walls, opposed end walls, a roof covering the car and having an opening therein for loading lading into the car, a bottom having a plurality of outlets attached thereto for discharging the lading from the car, each said outlet comprising a drop-bottom outlet having a pair of doors and means for selectively opening the doors of the outlet independently of each other, the cross sectional area of the outlet being sufficient to substantially prevent lading from bridging over the outlet and to facilitate discharge of lading;

a substantially vertical sheet extending transverse to the longitudinal axis of the car and attached to the inner surface of the respective side walls of the car at the base thereof for attaching the outlets to the bottom of the car; and a pair of spaced apart sheets for attaching each outlet to the bottom of the car, the spacing between the sheets, at the bottom edge thereof being equal to the width of the outlet, the sheets being substantially vertical when attached to the side walls of the car to maximize the discharge area provided by the outlets, the combined outlet area created by the outlets substantially eliminating support for any bridging material thereby causing any of the lading which may tend to bridge to collapse into the outlet for being discharged from the car through the outlets.

5. The car of claim 4 wherein the sheets for the respective adjacent ends of adjacent outlets are connected at their respective upper ends.

6. The car of claim 5 further including stiffening means for reinforcing the sheets.

7. The car of claim 6 wherein the stiffening means comprises a plurality of horizontal members extending between the sheets and positioned intermediately along the length thereof.

8. The car of claim 4 further including means for vibrating the car thereby to aid in the discharge of said lading, the vibrating means including a vibrator pad attached to at least one side of the car for attaching a vibrator to the pad to shake the car.

9. The car of claim 8 wherein the vibrating means includes a plurality of vibrating pads attached to each side of the car.

10. The car of claim 9 wherein the vibrator pads are attached to the sides of the car intermediate adjacent outlets.

11. The car of claim 4 wherein each said outlet has a discharge area for lading of at least thirty-two square feet.

12. In a covered hopper railway car having a pair of side walls, opposed end walls, a roof with an opening therein through which lading is loaded into the car, and a car bottom having at least one opening therein through which lading is discharged from the car, the improvement comprising: a plurality of drop-bottom outlet assemblies attached to the bottom of the car about the opening, each outlet assembly including a pair of opposed, separately openable swing away covers movable in opposite directions to open their respective portions of the outlet, the outlet area exposed by the covers when they are open being sufficiently large to substantially prevent bridging of lading over the outlet thereby facilitating its discharge; and spaced apart sheets extending transverse to the longitudinal axis of the car and attached to the inner surface of the respective side walls of the car for attaching the outlet to the bottom of the car the sheets for the respective adjacent ends of adjacent outlets being connected at their respective upper ends, the sheets being substantially vertical when attached to the side walls of the car to maximize the discharge area provided by the outlets the, the combined outlet area created by the outlets substantially eliminating support for any bridging material thereby causing the bridge material to collapse and discharge out the car through the outlets.

13. The improvement of claim 12 further including means for vibrating the car.

14. The improvement of claim 13 wherein the vibrating means includes a vibrator pad attached to each side of the car intermediate adjacent outlets.

15. A covered hopper railway car for transporting a lading, including a pair of parallel, spaced apart side walls, opposed end walls, a roof covering the car and having an opening therein for loading lading into the car, and a bottom having a plurality of outlets attached thereto for discharging lading from the car, a substantially vertical sheet extending transverse to the longitudinal axis of the car and secured to the inner surface of the respective side walls of the car at the base thereof for attaching the outlets to the bottom of the car, and a pair of spaced apart sheets for attaching each outlet to the bottom of the car, the spacing between the sheets at the bottom edge thereof being substantially equal to the width of the outlet with the sheets being substantially vertical when attached to the side walls of the car thereby to maximize the discharge area provided by said outlets, the combined outlet area created by the outlets substantially eliminating support for any bridging material thereby causing any of the lading which may tend to bridge across the outlets to collapse into the outlets and to be discharged from the car through the outlets.

16. In a covered hopper railway car having a pair of side walls, opposed end walls, a roof with an opening therein through which lading is loaded into the car, and a car bottom having a plurality of openings therein through which lading is discharged from the car, the improvement comprising a plurality of drop-bottom outlet assemblies attached to the bottom of the car, spaced apart sheets extending transverse to the longitudinal axis of the car and attached to the inner surface of the respective side walls for attaching the outlets to the bottom of the car, the sheets for respective adjacent outlets being connected to their respective upper ends and being substantially vertical when attached to the side walls of the car thereby to maximize the discharge area provided by the outlets, each outlet assembly including a pair of opposed, separately openable swing away covers movable in opposite directions to open their respective portions of the outlet, the outlet area exposed by the covers when they are open being sufficiently large to substantially prevent bridging of lading over the outlets thereby facilitating its discharge.

* * * * *